US006062311A

United States Patent [19]

Johnson et al.

[11] Patent Number: 6,062,311

[45] Date of Patent: May 16, 2000

[54] JETTING TOOL FOR WELL CLEANING

[75] Inventors: Ashley Bernard Johnson, Milton; David Scott, Huntingdon, both of United Kingdom; David M. Eslinger, Broken Arrow, Okla.

[73] Assignee: Schlumberger Technology Corporation, Sugar Land, Tex.

[21] Appl. No.: 08/987,963

[22] Filed: Dec. 10, 1997

[30] Foreign Application Priority Data

May 2, 1997 [GB] United Kingdom ..... 9708883

[51] Int. Cl.[7] ..... E21B 37/00

[52] U.S. Cl. ..... 166/312; 166/223

[58] Field of Search ..... 166/312, 304, 166/222, 223, 242, 902

[56] References Cited

U.S. PATENT DOCUMENTS 5,337,819 8/1994 Tailby .

FOREIGN PATENT DOCUMENTS 0587240 1/1978 U.S.S.R. ..... 166/223
1568680 10/1976 United Kingdom .
2228026 12/1989 United Kingdom .

OTHER PUBLICATIONS

"Combined Search and Examination Report", U.K. Patent Office, Cardiff Road, Newport, Gwent NP9 1RH, Jun. 27, 1997.

*Primary Examiner*—William Neuder
*Attorney, Agent, or Firm*—Gordon G. Waggett; Robin C. Nava

[57] ABSTRACT

An apparatus for cleaning subterranean wellbores is described. The apparatus comprises a sleeve member which is fixed to a part of the drillstring and a rotatable jet head with nozzles through which an abrasive fluid is discharged. The nozzles are mounted such that the fluid jet is directed to an area of the wellbore immediately adjacent to a leading edge of the sleeve. The nozzle head is restricted in its protrusion out of the sleeve.

9 Claims, 4 Drawing Sheets

JETTING TOOL FOR WELL CLEANING

The present invention relates to an improved apparatus for cleaning a hydrocarbon well using a jet drilling apparatus. The invention particularly relates to a penetration control system or stabiliser system for such jet drilling apparatus and more particularly to removal of scale and other downhole deposits from the inside diameter of well tubulars.

BACKGROUND OF THE INVENTION

It has been common practice for many years to run a continuous reeled pipe (known extensively in the industry as "coil tubing") into a well to perform operations utilising the circulation of treating and cleanout fluids such as water, oil, acid, corrosion inhibitors, hot oil, nitrogen, foam, etc. Coil tubing, being continuous rather than jointed, is run into and out of a well with continuous movement of the tubing through a coil tubing injector.

Coil tubing is frequently used to circulate cleanout fluids through a well for the purpose of eliminating sand bridges, scale, and similar downhole obstructions. Often such obstructions are very difficult and occasionally impossible to remove because of the inability to rotate the coil tubing and drill out such obstructions. These well tubulars vary from unperforated and perforated pipe, large diameter casing, production tubing, and slotted or wire-wrapped well liner. Well tubulars often become plugged or coated with corrosion products, sediments and hydrocarbon deposits. The deposits may consist of silicates, sulphates, sulphide, carbonates, calcium, and organic growth.

It is desirable to perform drilling type operations in wells through use of coil tubing which can be run into and removed from a well quickly in addition to performing the usual operations which require only the circulation of fluids. The same types of well servicing can also be performed with various small diameter work strings. The present invention may be used with such work strings and is not limited to coil tubing.

High pressure fluid jet systems have been used for many years to clean the inside diameter of well tubulars. Examples of such systems are disclosed in the following U.S. Pat. Nos.: 3,720,264, 3,811,499, 3,829,134, 3,850,241, 4,088,191, 4,349,073, 4,441,557, 4,442,899, 4,518,041, 4,919,204, 5,181,576 or 5,337,819.

In U.S. Pat. No. 3,720,264, there is disclosed a jet tool for cleaning a liner. At its one end, the tool carries a bit to provide mechanical centralisation. The blades of the bit are selected to be only slightly less in diameter than the inside diameter of the liner which is to be cleaned.

U.S. Pat. No. 5,337,819 discloses a washing tool for removing internal deposits in tubing parts and components in wells for oil. and gas production. The known tool comprises an actuation sleeve which has lateral dimensions related to the deposits to be removed. The sleeve actuates a valve to discharge a fluid jet through one or more discharge nozzles.

In view of the above cited prior art it is an object of the invention is to provide a fluid jet cleaning tool to remove scale and other deposits from the inside diameter of a well tubular. It is a particular object of the invention to provide a novel stabilising and/or centralising means for such a fluid jet cleaning tool.

SUMMARY OF THE INVENTION

The objects of the invention are achieved by apparatus as set forth in the appended independent claims.

In a first aspect of the invention, there is provided a gauge defining sleeve member. The sleeve member is mounted such that its lower weight-carrying edge is positioned in immediate vicinity of the trailing edge of a jet discharged through nozzles of a rotating head of a jet cleaning tool. Debris and deposits are hence removed preferably from an area immediately below the lower edge of the sleeve member.

The sleeve member is rigidly fixed to the coiled tubing or drillstring. Sleeve member and coiled tubing are isolated from the rotation of the nozzle head. In this arrangement, the sleeve member does not rotate relatively to the coiled tubing or drillstring.

The lower edge of the sleeve-member is shaped such that the supporting surface area, which, in operation, contacts the deposits, has an essentially annular outline. This essentially annular supporting surface may be interrupted by openings or cuts as described below. The width, or, in cases where the lower edge of the sleeve member is rounded, the radius of curvature of the area is preferably less than 10 mm, more preferably less that 5 mm.

With respect to the prior art, it is another important feature of the present invention that the protrusion of nozzle head is limited so as to ease the introduction of the tool into a well and to prevent damages to the tool caused by obstacles in the well.

In order to reduce the lateral dimensions of the tool, it is therefore an aspect of the invention, that the nozzles are located within a protruding distance of less that 0.5 times the outer diameter of the sleeve member. Preferably the protrusion is less than 0.3 times the outer diameter of the sleeve member. The protruding distance is measured as the vertical distance between the lower edge of the sleeve member and lowest nozzle. Even more preferably it is the protrusion of the nozzle head which is limited to the value given above, resulting in a very compact tool design.

The lower part of the nozzle head is preferably formed in a tapered shape, e.g. rounded or conical.

The main body of sleeve member has openings which form a passage for the cleaning fluids and cuttings. Preferably, the openings have a slit-like shape and are cut into the lower edge of the sleeve member. The preferred dimensions of the openings allow cuttings with less than 2 mm diameter to pass.

In a preferred embodiment of the invention, the lower edge of the sleeve essentially forms an annular area which, in operation, i.e. when the downward motion of the tool is obstructed by deposits, carries the full weight of the tubular lowered into the well. Thus the jet cleaning tool will progress only when debris below the sleeve member has been completely removed.

In a further preferred embodiment, the sleeve member comprises a frusto-conical shaped main body and a cylindrical part the outer surface of which engages against the wall of the tubular to be cleaned.

In another aspect of the invention, an frustro-conical shaped protection member is mounted on the sleeve member such that the tapered end of the protection member points in direction of the bottom of the borehole. The protection member facilitates the process of lowering the tool into the wellbore. The base material of the protection member is chosen such that it can be readily dissolved or eroded by acids or abrasive fluid jets.

These and other features of the invention, preferred embodiments and variants thereof, and advantages will become appreciated and understood by those skilled in the art from the detailed description and drawings following hereinafter.

MODE(S) FOR CARRYING OUT THE INVENTION

The invention is now described with reference to the attached drawings.

Figure 1:
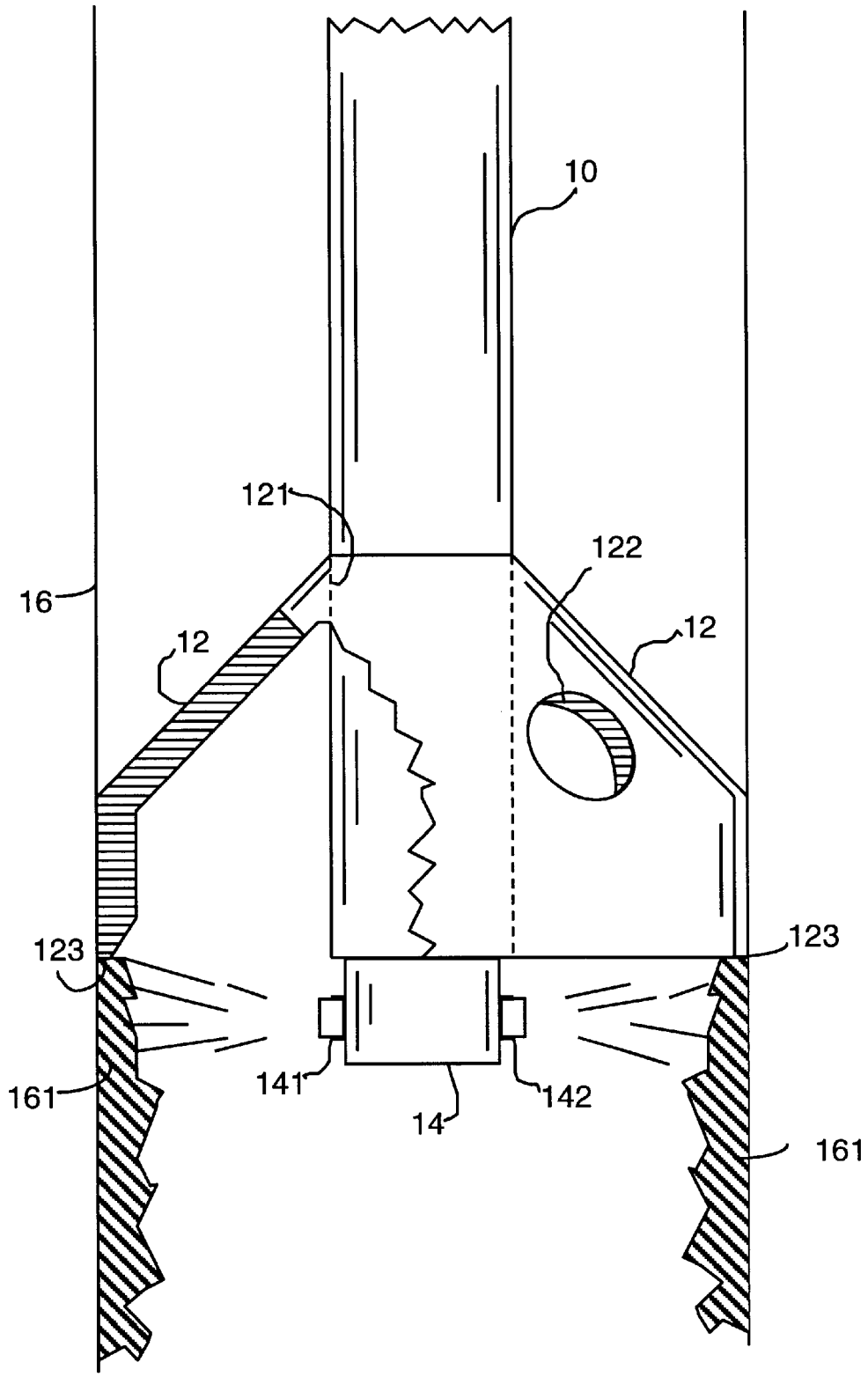
FIG. 1 schematically shows a jet cleaning tool in accordance with the invention.

The basic components of the invention are illustrated in FIG. 1. There is shown the lower part 10 of a hollow tube representing a drillstring or a coiled tubing. Attached to the tube is a sleeve member 12. The sleeve member in the described example is made of a solid cylinder of engineering steel having an outer diameter of 75 mm and a centre bore 121 of 45 mm. An alternative material may be tungsten carbide or other steels of sufficient hardness.

Further components of the system are a nozzle head 14 which carries two nozzles 141, 142. The nozzle head is rotatably mounted in the drillstring 10.

In operation, the coiled tubing is reeled off to lower the tool arrangement including nozzle head 14 and sleeve member 12 into the wellbore 16. When the lower edge 111 of the sleeve member encounters an obstruction, e.g. deposits 161 to be removed, the downward progress of tool is stopped. At this point, the sleeve member 12 carries the weight of the coiled tubing. The operator activates the pumps to discharge jets of cleaning fluids through the nozzles 142, 142. The fluid and cuttings are pumped to the surface through openings 122. The rotating movement of the nozzle head 14 is energised by the fluid flow by means of like turbines within the tool arrangement or by designing the nozzles such that rotation is effected by the discharge of the fluid. Though both methods are feasible, the latter is simpler and can be readily implemented by, for example placing nozzles such that a net rotating force is generated. It is important to note that the nozzle head 14 protrudes less than the outer diameter of the sleeve member 12. In the present example, the protrusion of the nozzle head, measured as the vertical distance between the lowest part of the nozzle head 14 and the lower edge 123 of the sleeve member is 2 cm. The limited protrusion of the nozzle ensures that the sleeve member 12 is the first part of the tool to contact any deposits.

Depending on the nature of the deposits, the fluid jets are loaded with appropriate abrasives. The nozzles 142, 142 are oriented such that the jets remove the debris 161 immediately below the weight-carrying edge 123 of the sleeve 12. The tool advances through the well tubing as the deposits are removed. The outer dimensions of the sleeve member determine the gauge of the cleaned wellbore.

After removing the debris, the fluid flow through the tool is interrupted and the tool is either moved downwards to other locations within the same wellbore or it is lifted by reeling up the coiled tubing 10.

Figure 2:
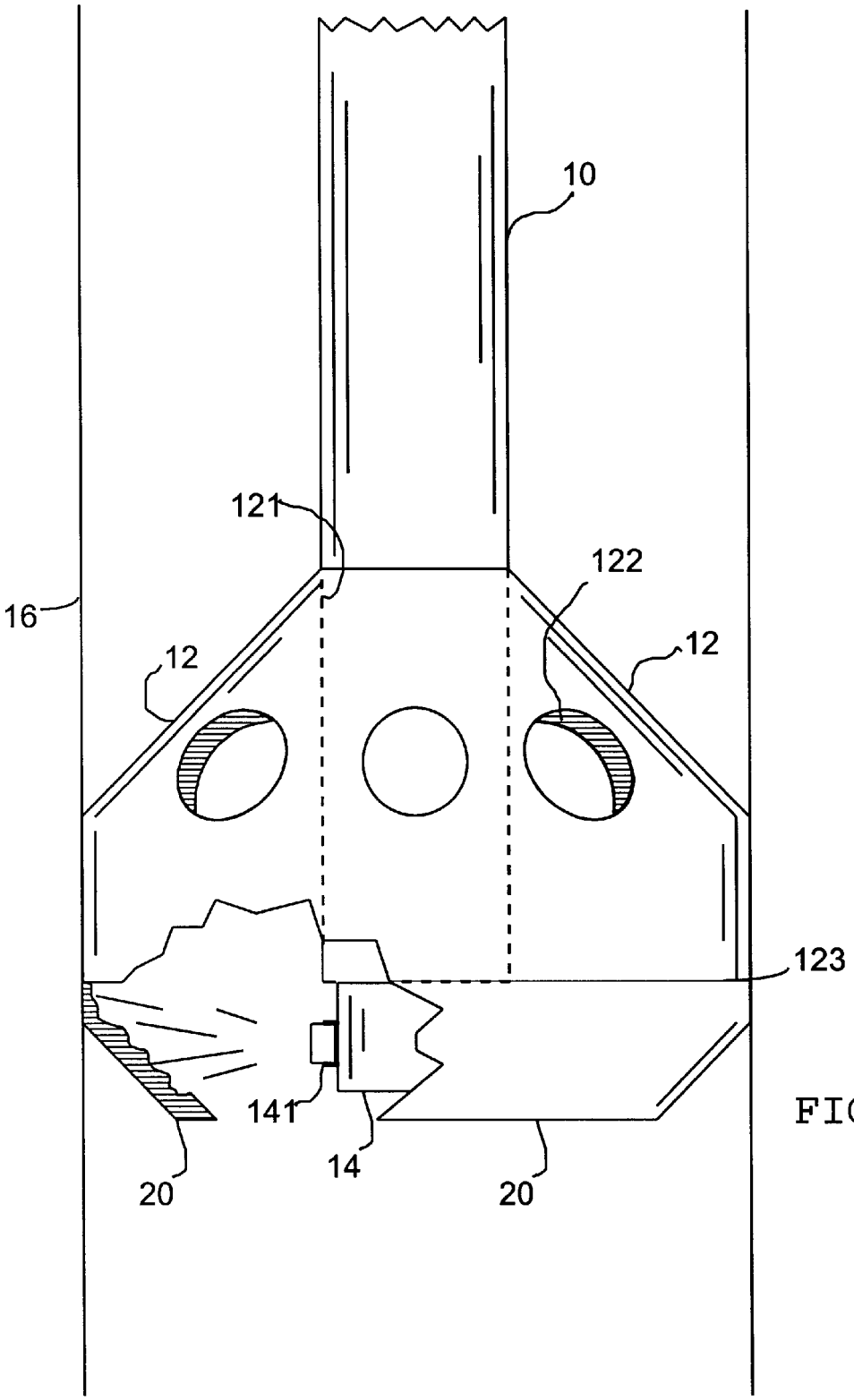
FIG. 2 shows a jet cleaning tool in accordance with a preferred embodiment of the invention.

Referring now to FIG. 2, mounted on the device of FIG. 1, there is shown a protection sleeve 20. The protection sleeve partially encapsulates the protruding part of nozzle head, thus facilitating the introduction of the tool through installation at the surface and within the wellbore. The protection sleeve is either pressed or glued onto the lower edge 123 of the sleeve member 12. The material of the protection sleeve is chosen such that it is readily dissolvable by acid treatment or eroded by the abrasive fluid, itself. Examples for suitable materials are plastics, such as phenolic resins, reinforced by glass fibres or a metal mesh, such as or aluminium. Aluminium is dissolved by pumping an acid (HCl) prior to the abrasive fluid while the reinforced resin can be removed by the jetting action of the fluid.

Figure 3A:
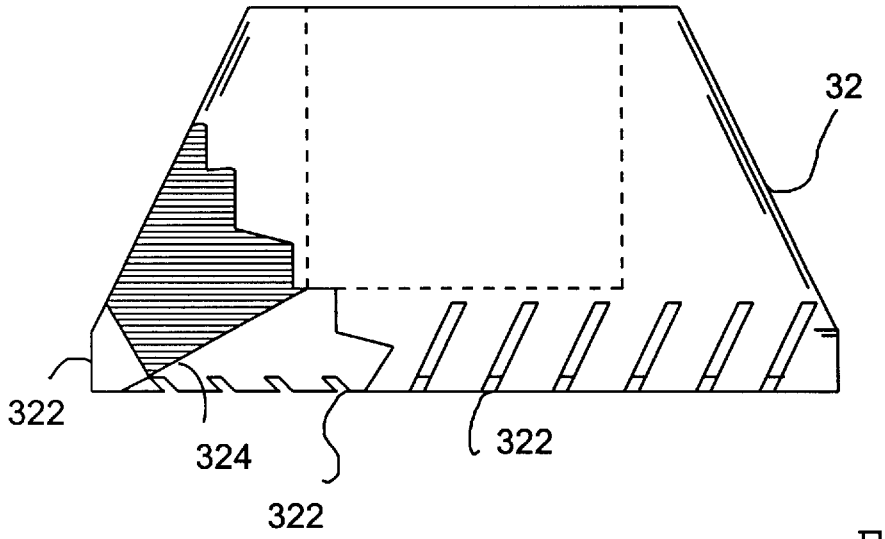
FIGS. 3A,B show a jet cleaning tool in accordance with a preferred embodiment of the invention showing differently designed openings.
Figure 3B:
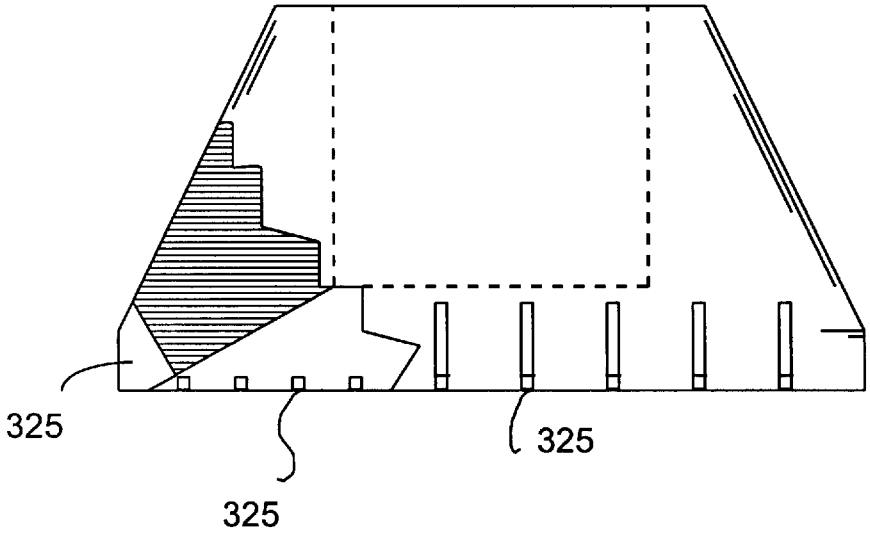

FIGS. 3A and 3B illustrate variants of the sleeve member according to the invention. The sleeve member of FIG. 3A has openings formed as slanted slits 322 cut into the lower edge of the sleeve member. Together with an appropriate coning 324 of the inner surface of the member a volume is formed in which larger cuttings are trapped until they can pass through one of the openings 322. The slits 322 are 2 mm wide and 10 mm deep. The slant angle is 60 degrees. In FIG. 3B, a similar sleeve member is shown having a slant angle of 90 degrees.

Figure 4:
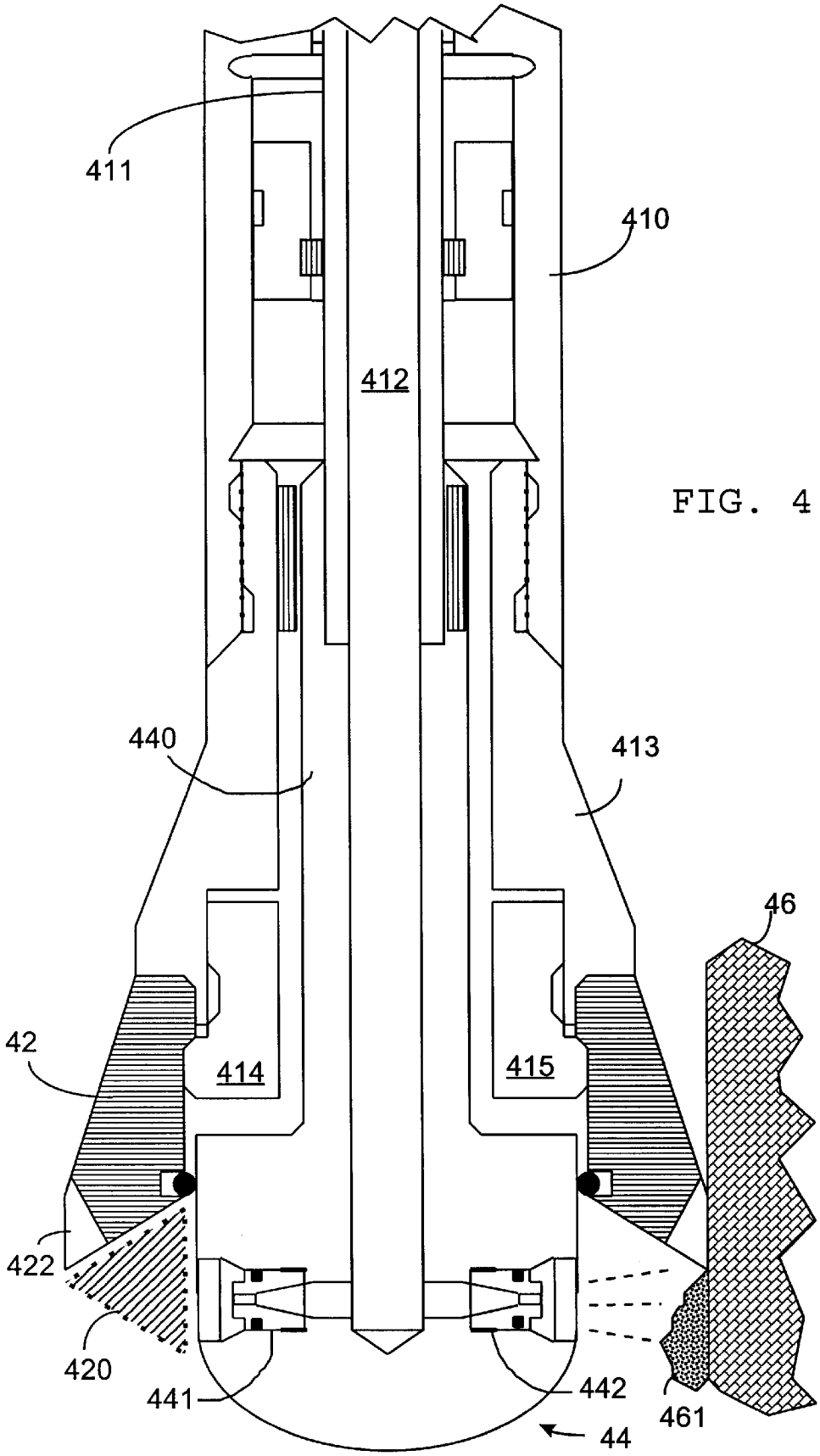
FIG. 4 shows a jet cleaning tool in accordance with a preferred embodiment of the invention.

In FIG. 4, a more detailed view of an example in accordance with the invention is shown. The tool arrangement shown displays the bottom part of a swivel shaft 411 mounted in a swivel housing 410. Connected to the swivel shaft there is a nozzle shaft section 440 and a nozzle head 44 with the nozzles 441 and 442. An adapter section 413 with clamps 414, 415 is connected to the bottom part of the swivel housing. A sleeve member 42 is mounted on the adapter section and is held in place by the clamps. On the left of the figure, a hatched triangle indicates the position of a protection sleeve 420, whereas on the right the tool is shown in operation with area 46 denoting a part of wellbore and area 461 deposits to be removed.

In operation, the abrasive fluids enter the nozzle head through a bore 412 in the swivel shaft 411. The fluid is then discharged via nozzles 441, 442. Rotational motion of the nozzle head can be generated by a turbine attached to the swivel shaft or be nozzle design and location. The fluid and cuttings are pumped through openings 422 to the surface.

During the operation, an operator controls the weight set down on the lower edge of the bit in the same manner as the weight-on-bit (WOB) would be controlled during a drilling operation. As the tool removes the debris, it advances causing the monitored weight to fall and allowing the operator to reel off more tubing. As soon as the monitored weight exceeds a predetermined threshold, the operator initiates the pumping of the jetting fluids.

What is claimed is:

1. Fluid jet cleaning apparatus for a wellbore through subterranean formations, said apparatus comprising a gauge defining sleeve member having a leading edge and a lower edge and a nozzle head mounted on a part of a lower end of a hollow tubular characterize in that, in operation, said nozzle head performs a rotational movement relatively to said sleeve member and at least one nozzle of said nozzle head is directed such that a discharged fluid jet targets an area of the well immediately below said sleeve member.

2. The apparatus of claim 1, wherein said sleeve member has an essentially annular edge of a width of less than 10 mm.

3. The apparatus of claim 1, wherein said sleeve member has an essentially annular edge of a width of less than 5 mm.

4. The apparatus of claim 1, wherein the said sleeve member has openings allowing fluid to pass through said the sleeve member.

5. The apparatus of claim 1, wherein a protruding part of the nozzle is partly encapsulated in a protection member during the introduction of the apparatus into the well.

6. The apparatus of claim 5, wherein the protection member is made of a material dissolvable by an acid or erodable by the fluid jet.

7. The apparatus of claim 1 attached to a string of coiled tubing.

8. Use of a system according to claim 1 for cleaning a well in a subterranean formation.

9. Method for cleaning a well in a subterranean formation comprising the steps of lowering a gauge defining sleeve member and a nozzle head mounted on a part of a lower end of a hollow tubular into said well;

carrying a weight on the sleeve; and when said weight exceeds a predetermined limit pressurising a fluid to be discharged through at least one nozzle of said nozzle head, thereby energising a rotational movement of said nozzle head relatively to said sleeve member and directing said least one nozzle such that discharged fluid targets an area of said well immediately below said sleeve member.

* * * * *